US007429924B2

(12) United States Patent
Langer et al.

(10) Patent No.: US 7,429,924 B2
(45) Date of Patent: Sep. 30, 2008

(54) AUTOMATIC DOORBELL DRIVER

(76) Inventors: Peter Langer, 3351 NE. Luna Ter., Jensen Beach, FL (US) 34957; Douglas Carl Cinzori, P.O. Box 405, Dearborn, MI (US) 48121

( * ) Notice: Subject to any disclaimer, the term of this patent is extended or adjusted under 35 U.S.C. 154(b) by 65 days.

(21) Appl. No.: 11/559,373

(22) Filed: Nov. 13, 2006

(65) Prior Publication Data

US 2007/0126574 A1 Jun. 7, 2007

Related U.S. Application Data

(60) Provisional application No. 60/741,746, filed on Dec. 2, 2005.

(51) Int. Cl.
*G08B 13/00* (2006.01)

(52) U.S. Cl. ..... 340/541; 340/692; 340/384.1; 340/565; 340/392.1

(58) Field of Classification Search ..... 340/541, 340/692, 286.02, 551, 384.1, 391.1, 384.6, 340/392.1, 552, 553, 561, 565
See application file for complete search history.

(56) References Cited

U.S. PATENT DOCUMENTS 3,774,191 A * 11/1973 Enemark ..... 340/563
3,886,352 A * 5/1975 Lai ..... 250/215
4,236,147 A 11/1980 Calvin
4,523,193 A 6/1985 Levinson et al.
5,169,118 A 12/1992 Whiteside
5,428,388 A * 6/1995 von Bauer et al. ..... 348/155
5,748,074 A * 5/1998 Chomet ..... 340/328
5,774,039 A 6/1998 Housley
5,894,262 A 4/1999 McCavit et al.
6,414,589 B1 * 7/2002 Angott et al. ..... 340/326
6,965,301 B2 11/2005 Epstein et al.
7,023,327 B1 * 4/2006 Chen ..... 340/392.5
2004/0095254 A1 5/2004 Maruszczak

* cited by examiner

*Primary Examiner*—Toan N Pham
(74) *Attorney, Agent, or Firm*—Douglas C. Cinzori

(57) ABSTRACT

An automatic doorbell driver that utilizes the power, wiring, and primary load of a conventional doorbell system. The automatic doorbell driver comprising coupling means for coupling the automatic doorbell driver to the conventional doorbell system; power supply means for supplying power to the automatic doorbell driver; sensing means for sensing an object in a proximity zone; and switching means responsive to the sensing means for coupling power to, and thereby controlling the energization and de-energization of, the primary load of the conventional doorbell system; whereby the automatic doorbell driver can easily convert the conventional doorbell system into an automatic doorbell system.

19 Claims, 3 Drawing Sheets

AUTOMATIC DOORBELL DRIVER

CROSS-REFERENCE TO RELATED APPLICATIONS

This application claims the benefit of U.S. Provisional Patent Application Ser. No. 60/741,746, filed Dec. 2, 2005.

BACKGROUND OF THE INVENTION

This invention relates generally to doorbell systems and particularly to an automatic doorbell driver that utilizes the power, wiring, and primary load of a conventional doorbell system.

Conventional doorbell systems in buildings, typically residences, throughout the United States and elsewhere are hardwired and comprise a transformer, a primary load, and a pushbutton. The transformer lowers standard household AC voltage to a level required to operate the primary load. The primary load is an electromagnetic or electronic sound device that operates on low voltage and is typically a bell, buzzer, or chime. The pushbutton is a typically a normally open switch. System activation requires physical contact with the pushbutton. Manual depression of the pushbutton closes an electrical circuit causing the primary load to energize. Often there is no feedback provided to inform the activator that the primary load has been energized.

Considerations of convenience, sanitation, security, and/or simply surprise and delight have led to the development of automatic doorbell systems. That is, doorbell systems that can automatically detect a person's presence outside a doorway and alert a person inside when such a detection occurs. Both U.S. Pat. No. 4,236,147 to Calvin (1980) and U.S. Pat. No. 5,428,388 to von Bauer et al. (1995) disclose such a system.

Unfortunately, all of the systems devised thus far, including Calvin's and von Bauer's, have a significant disadvantage that has prevented their widespread application. That is, they are either independent or predominately independent systems that do not, or do not sufficiently, interface with or complement a conventional doorbell system. As a result, they are complex, difficult to install, expensive, redundant, and/or require periodic maintenance (e.g., battery replacement).

BRIEF SUMMARY OF THE INVENTION

In light of the foregoing, the primary object and advantage of the present invention is to provide a simple, easy to install, inexpensive, and maintenance free means to automate the operation of a conventional doorbell system. Further objects and advantages will become apparent from a consideration of the ensuing description and drawings.

The present invention is an automatic doorbell driver that is a perfect drop-in replacement device for a pushbutton of a conventional doorbell system and which upon installation converts a conventional doorbell system into an automatic doorbell system.

DETAILED DESCRIPTION OF THE INVENTION

Figure 2:
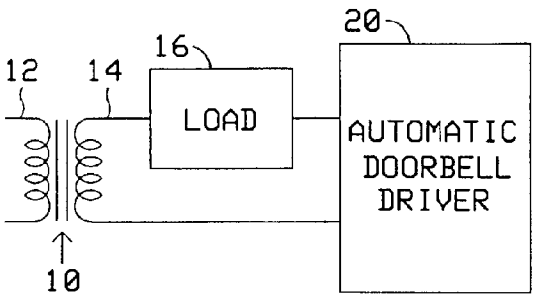
FIG. 2 is a schematic block diagram of an automatic doorbell system utilizing an automatic doorbell driver according to the present invention.

In the following description and operation sections, the same reference numerals are used to identify the same components in the various views. While the present invention is described and illustrated herein with reference to specific embodiments, various alternate embodiments that do not depart from the scope and spirit of the invention will be evident to those skilled in the art. For example, the visible light sensor described below could be replaced or supplemented by an audible sound sensor, a capacitive sensor, an infrared sensor, a microwave sensor, a radio frequency sensor, or an ultrasonic sensor. Similarly, the microprocessor circuit described below could be replaced or supplemented by a discrete logic circuit, an application specific integrated circuit, or a state machine circuit. Other examples will become apparent from a consideration of the ensuing description and drawings.

DESCRIPTION OF FIRST EMBODIMENT

Figure 1:
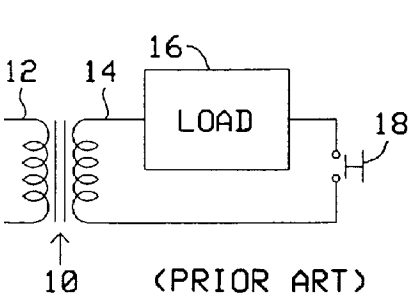
FIG. 1 (PRIOR ART)
FIG. 1 is a schematic block diagram of a conventional doorbell system utilizing a pushbutton.

Referring to FIG. 1, a schematic block diagram of a conventional doorbell system utilizing a pushbutton 18 is illustrated. Referring to FIG. 2, a schematic block diagram of an automatic doorbell system utilizing a novel automatic doorbell driver 20 is illustrated. Comparison of these FIGS. shows that automatic doorbell driver 20 is a drop-in replacement device for pushbutton 18, electrically coupling directly to the conventional doorbell system's pushbutton wires. The automatic doorbell system shown in FIG. 2 comprises a conventional transformer 10, a conventional primary load 16, and automatic doorbell driver 20. Transformer 10 comprises a primary winding 12 and a secondary winding 14. Primary winding 12 of transformer 10 is connected to a standard household AC voltage supply. Secondary winding 14 of transformer 10 is connected in series to primary load 16 and automatic doorbell driver 20. Transformer 10 lowers the standard household AC voltage to a level required to operate primary load 16. Primary load 16 is an electromagnetic sound device that operates on low voltage and is typically a bell, buzzer, or chime.

The power necessary to operate automatic doorbell driver 20 is extracted from the conventional doorbell system. Automatic doorbell driver 20 is configured so that power is extracted from the conventional doorbell system in an amount sufficiently large so as to permit operation of automatic doorbell driver 20 but sufficiently small so as to prevent inadvertent energization of primary load 16.

Figure 3:
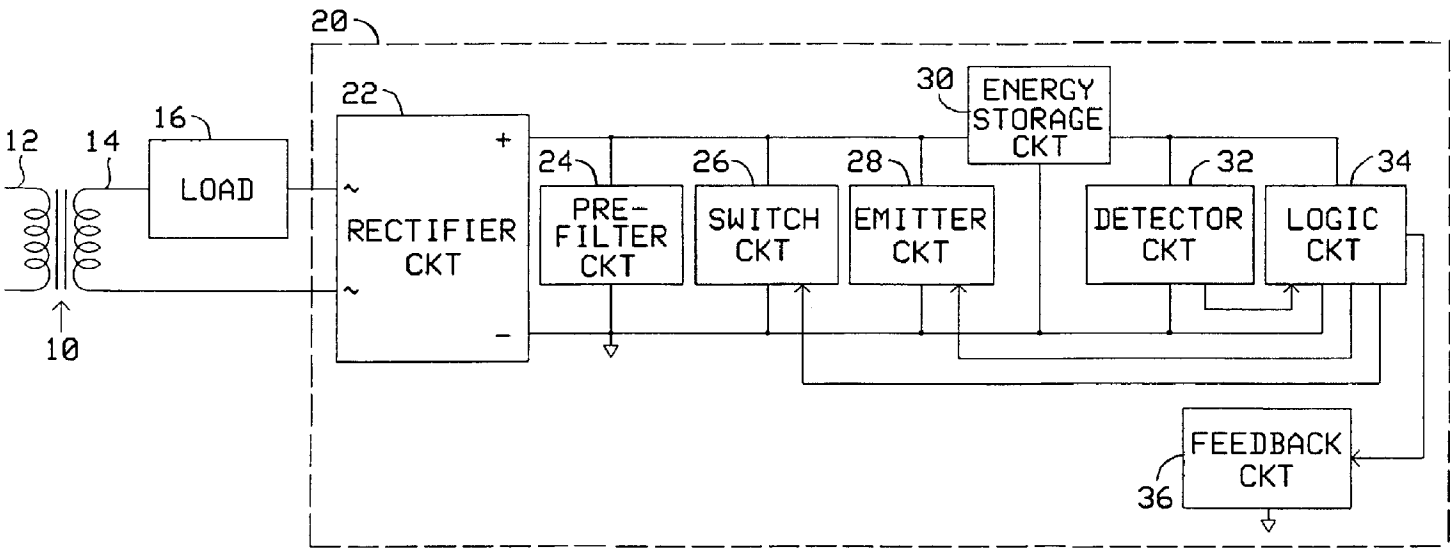
FIG. 3 is a schematic block diagram of the automatic doorbell system shown in FIG. 2 including the major components of the automatic doorbell driver.
Figure 4:
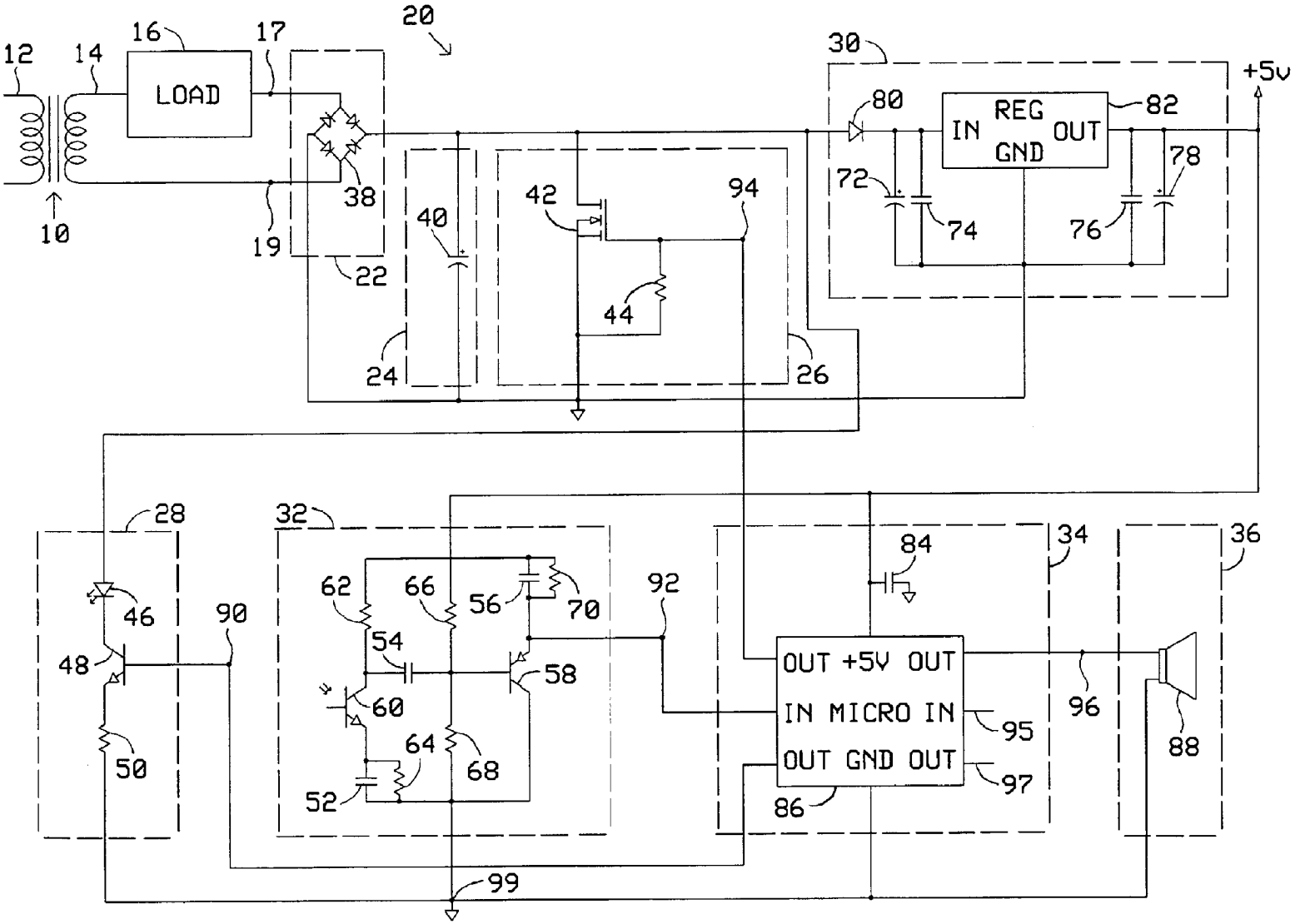
FIG. 4 is an electrical schematic of the automatic doorbell system shown in FIG. 3.

Referring now to FIGS. 3 and 4, a schematic block diagram of the automatic doorbell system including the major components of automatic doorbell driver 20 and an electrical schematic of the automatic doorbell system are respectively illustrated. As shown in these FIGS., automatic doorbell driver 20 comprises a rectifier circuit 22, a pre-filter circuit 24, a switch circuit 26, an emitter circuit 28, an energy storage circuit 30, a detector circuit 32, a logic circuit 34, and a feedback circuit 36.

Rectifier circuit 22 comprising full-wave bridge rectifier 38 converts the stepped down household AC voltage into pulsating DC voltage. Pre-filter circuit 24 comprising capacitor 40 reduces the ripples in the pulsating DC voltage. Switch circuit 26 comprising N-channel enhancement mode metal oxide semiconductor field effect transistor (MOSFET) 42 and resistor 44 operates as a switch that is controlled by logic circuit 34. Emitter circuit 28 comprising visible light emitting diode 46, NPN bipolar transistor 48, and resistor 50 emits pulsed visible light. Energy storage circuit 30 comprising capacitors 72, 74, 76, 78, diode 80, and low dropout regulator 82 stores energy in a sufficient amount so as to permit continued operation of both automatic doorbell driver 20 and primary load 16 when switch circuit 26 is coupling power to primary load 16. Detector circuit 32 comprising capacitors 52, 54, 56, PNP bipolar transistor 58, NPN phototransistor 60, and resistors 62, 64, 66, 68, 70 senses reflected visible light. Logic circuit 34 comprising capacitor 84 and microprocessor 86 performs logic operations according to microprocessor 86's programming. Microprocessor 86 is conventional in the art and may comprise a PIC12F675microcontroller manufactured by Microchip Technology Inc., 2355 West Chandler Blvd., Chandler, Ariz. 85224. Feedback circuit 36 comprising speaker 88 operates as a sound device that is controlled by logic circuit 34.

OPERATION OF FIRST EMBODIMENT

Operation of automatic doorbell driver 20 comprises three phases; a sensing phase, an activation phase, and a feedback phase.

During the sensing phase, microprocessor 86 provides a pulsed voltage above a threshold level at node 90 thereby intermittently turning on transistor 48 and diode 46 causing diode 46 to emit pulsed light toward a proximity zone outside a building's doorway. When an object, such as a person, enters the proximity zone, the pulsed light is reflected off the object and is thereupon sensed by phototransistor 60 which in conjunction with capacitor 52 and resistors 62, 64 operates as an inverting amplifier configured to provide unity DC gain and high AC gain. This configuration ensures that the amplifier is most responsive to pulsed light emitted from diode 46 and least responsive to steady state light emitted from other sources such as incandescent light or daylight. The sensed reflected pulsed light off the approaching object results in an inverted pulsed voltage at the collector of phototransistor 60 which passes through AC coupling capacitor 54 to the base of transistor 58. Transistor 58 in conjunction with capacitor 56 and resistors 66, 68, 70 operates as an emitter-follower configured as a peak detector to capture the pulsed voltage at the collector of phototransistor 60. Resistors 66 and 68 provide a positive DC voltage bias at the base of transistor 58 resulting in a corresponding DC voltage bias at node 92 that is one diode drop greater than the voltage at the base of transistor 58. The inverted pulsed voltage at the base of transistor 58 results in a corresponding inverted pulsed voltage at node 92 which is superimposed on the positive DC voltage bias. When microprocessor 86 senses voltage pulses below a threshold level and above a threshold frequency of occurrence at node 92, it turns off transistor 48 and diode 46 and operation enters the activation phase.

During the activation phase, microprocessor 86 provides a voltage above a threshold level at node 94 thereby turning on MOSFET 42 causing primary load 16 to energize. MOSFET 42 operates in the saturation region thereby shunting all the stepped down and rectified household AC voltage away from energy storage circuit 30, detector circuit 32, and logic circuit 34. During this time, the energy required to power automatic doorbell driver 20, including logic circuit 34, is obtained from capacitor 78 causing capacitor 78 to partially discharge. When MOSFET 42 has been on for a requisite period of time (i.e., a period long enough for primary load 16 to produce a desired sound), microprocessor 86 turns off MOSFET 42 and operation enters the feedback phase.

During the feedback phase, the stepped down and rectified household AC voltage to energy storage circuit 30, detector circuit 32, and logic circuit 34 is restored and capacitor 78 is recharged. Thereafter, microprocessor 86 provides a pulsed or steady voltage above a threshold level at node 96 causing speaker 88 to energize thereby providing audible feedback informing the detected object that primary load 16 has been energized. Optionally, diode 46 could be utilized instead of or in combination with speaker 88 to provide visual feedback instead of or in combination with the audible feedback. When speaker 88 has been energized for a requisite period of time (i.e., a period long enough to produce a desired sound), microprocessor 86 de-energizes speaker 88 and operation returns to the sensing phase. Optionally, a delay may be incorporated prior to returning to the sensing phase.

Note that optionally, automatic doorbell driver 20 may further comprise an adjustable sensing range and an ambient light sensor. Utilization of these optional elements may be desirable because they provide greater design flexibility. For example, these optional elements permit the timing of when primary load 16 is energized to be adjusted based on the distance of the sensed object within the proximity zone and/or the ambient light level. Short range sensing may be desirable during daytime whereas long range sensing may be desirable during nighttime for security. Alternatively, no sensing may be desirable during nighttime so as to prevent nuisance activations of primary load 16. To accomplish an adjustable sensing range, microprocessor 86 is programmed to recognize and respond to alternative voltage and/or frequency of occurrence thresholds at node 92. To accomplish ambient light sensing, a jumper (not shown) is connected from the collector of phototransistor 60 to input pin 95 of microprocessor 86. The voltage at the collector of phototransistor 60 and consequently the voltage at input pin 95 is inversely related to the light intensity that strikes phototransistor 60.

Note also that automatic doorbell driver 20 may further comprise a radio frequency transmitter. Utilization of this optional element provides still greater design flexibility. For example, it permits automatic doorbell driver 20 to communicate with a remote radio frequency receiver comprising a sound device. This permits the notification range of primary load 16 to effectively expand into other areas such as a basement, backyard, and/or garage. To accomplish radio frequency transmission, a radio frequency transmitter (not shown) is connected from output pin 97 of microprocessor 86 to node 99. When microprocessor 86 provides a voltage above a threshold level at node 97, the radio frequency transmitter energizes and thereby emits a radio frequency signal.

Note further that while this embodiment contemplates extracting the power necessary to operate automatic doorbell driver 20 from the conventional doorbell system, it will be evident to those skilled in the art that optionally the power necessary could be supplied via an independent internal power source such as a battery.

DESCRIPTION OF SECOND EMBODIMENT

Figure 5:
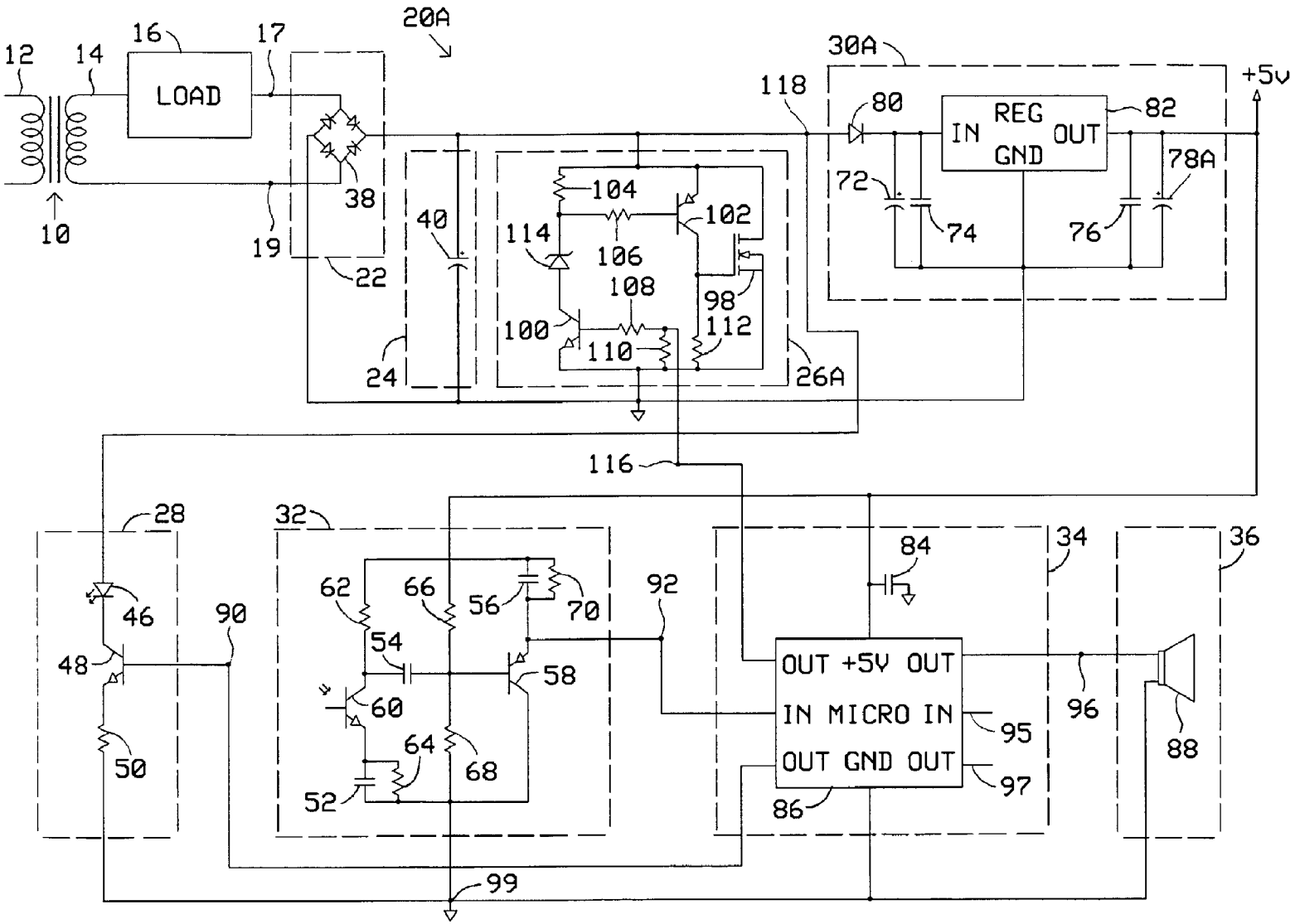
FIG. 5 is an electrical schematic of an automatic doorbell system utilizing an alternate embodiment of an automatic doorbell driver according to the present invention.

Referring now to FIG. 5, an electrical schematic of an automatic doorbell system utilizing an alternate embodiment of an automatic doorbell driver 20A is illustrated.

Unlike the previous embodiment, this embodiment utilizes power sharing rather than energy storing via a capacitor to permit continued operation of both automatic doorbell driver 20A and primary load 16. That is, this embodiment shares power between automatic doorbell driver 20A and primary load 16 in sufficient amounts so as to permit continued operation of both when switch circuit 26A is coupling power to primary load 16. Utilization of power sharing may be desirable because it provides greater design flexibility. For example, it permits an indefinite extension of the activation phase. Also, it permits operation of feedback circuit 36 during and/or subsequent to the activation phase rather than solely subsequent to the activation phase.

The automatic doorbell driver shown in FIG. 5 differs from that shown in FIG. 4 in that it includes switch circuit 26A in place of switch circuit 26 and energy storage circuit 30A in place of energy storage circuit 30. Energy storage circuit 30A includes capacitor 78A in place of capacitor 78; otherwise it is the same as energy storage circuit 30. Capacitor 78A is smaller than capacitor 78 because unlike the previous embodiment it is not used as a power source. Rather, it is used solely to stabilize the output of regulator 82. Switch circuit 26A comprising N-channel enhancement mode MOSFET 98, NPN bipolar transistor 100, PNP bipolar transistor 102, resistors 104, 105, 108, 110, 112, and Zener diode 114 operates both as a switch that is controlled by logic circuit 34 and also as a voltage limiting circuit, ensuring that a constant voltage source is available to power automatic doorbell driver 20A, including detector circuit 32 and logic circuit 34.

OPERATION OF SECOND EMBODIMENT

Like the previous embodiment, operation of this embodiment comprises three phases; a sensing phase, an activation phase, and a feedback phase. During the sensing phase, operation as identical to that of the previous embodiment.

During the activation phase, microprocessor 86 provides a voltage above a threshold level at node 116 causing current to flow through resistors 108 and 110 resulting in a corresponding voltage above a threshold level at the base of transistor 100 thereby turning on transistor 100. Resistor 108 limits the current at the base of transistor 100. Pull-down resistor 110 ensures that leakage current does not inadvertently turn on transistor 100. When transistor 100 is on, current flows through resistors 104, 106, and Zener diode 114 resulting in a voltage below a threshold level at the base of transistor 102 thereby turning on transistor 102. Pull-up resistor 104 ensures that leakage current does not inadvertently turn on transistor 102. Resistor 106 limits the current at the base of transistor 102. When transistor 102 is on, current flows through resistor 112 resulting in a voltage above a threshold level at the gate of MOSFET 98 thereby turning on MOSFET 98 causing primary load 16 to energize. Pull-down resistor 112 ensures that leakage current does not inadvertently turn on MOSFET 98. Unlike MOSPET 42 in the previous embodiment, MOSFET 98 operates in the linear rather than saturation region thereby shunting only a portion of the stepped down and rectified household AC voltage away from energy storage circuit 30A, detector circuit 32, and logic circuit 34. The portion of the voltage shunted away is set to a level sufficient to operate primary load 16. The balance of the voltage comprising the sum of the voltage drops across the base-emitter junction of transistor 102, resistor 106, Zener diode 114, and the collector-emitter junction of transistor 100 is maintained at node 118 and is set to a level sufficient to operate automatic doorbell driver 20A, including detector circuit 32 and logic circuit 34. When MOSFET 98 has been on for a requisite period of time (i.e., a period long enough for primary load 16 to produce a desired sound), microprocessor 86 removes the voltage from node 116 thereby turning off MOSFET 98.

The feedback phase in this embodiment occurs simultaneously with and/or subsequent to the activation phase. During the feedback phase, there is no capacitor to recharge since the logic circuit is powered by a constant voltage source; otherwise operation is identical to that of the previous embodiment.

DESCRIPTION OF THIRD EMBODIMENT

The previous embodiments are compatible with doorbell systems utilizing a conventional electromagnetic primary load. Referring again to FIGS. 4 and 5, to be compatible with doorbell systems utilizing a conventional electronic primary load a diode (not shown) is added with its cathode connected to node 17 and its anode connected to node 19 (or vice versa depending upon the requirements of the particular electronic primary load). The added diode operates as a half-wave rectifier resulting in a pulsating DC voltage that serves to provide primary load 16 with a constant source of power.

OPERATION OF THIRD EMBODIMENT

Operation of this embodiment is identical to that of the previous embodiments with the exception that during the activation phase, primary load 16 utilizes the stepped down household AC voltage coupled to it when MOSFET 42 or MOSFET 98 is turned on as a trigger rather than to directly produce a desired sound. When primary load 16 detects the trigger, it energizes an internal sound device. The sound device can remain energized indefinitely, even after the activation phase ends, due to the constant source of power provided by the added diode.

We claim:

1. An automatic doorbell driver, comprising:

a. coupling means for coupling said automatic doorbell driver to a conventional doorbell system wherein said conventional doorbell system comprises a primary load;

b. power extracting means for extracting power from said conventional doorbell system in an amount sufficiently large so as to permit operation of said automatic doorbell driver but sufficiently small so as to prevent inadvertent energization of said primary load of said conventional doorbell system;

c. sensing means for sensing an object in a proximity zone; and d. switching means responsive to said sensing means for coupling power to, and thereby controlling the energization and de-energization of, said primary load of said conventional doorbell system;

whereby said automatic doorbell driver can easily convert said conventional doorbell system into an automatic doorbell system.

2. The automatic doorbell driver of claim 1, wherein said power extracting means comprises energy storing means for storing energy in a sufficient amount so as to permit continued operation of said automatic doorbell driver and continued operation of said primary load of said conventional doorbell system when said switching means is coupling power to said primary load of said conventional doorbell system.

3. The automatic doorbell driver of claim 2, wherein said energy storing means comprises a capacitor.

4. The automatic doorbell driver of claim 1, wherein said power extracting means comprises power sharing means for sharing power between said automatic doorbell driver and said primary load of said conventional doorbell system in sufficient amounts so as to permit continued operation of said automatic doorbell driver and continued operation of said primary load of said conventional doorbell system when said switching means is coupling power to said primary load of said conventional doorbell system.

5. The automatic doorbell driver of claim 4, wherein said power sharing means comprises a voltage limiting circuit.

6. The automatic doorbell driver of claim 1, wherein said sensing means comprises a motion sensor.

7. The automatic doorbell driver of claim 1, wherein said sensing means has an adjustable range.

8. The automatic doorbell driver of claim 1, further comprising logic means for controlling said automatic doorbell driver including said sensing means.

9. The automatic doorbell driver of claim 1, further comprising feedback means for informing said object in said proximity zone that said primary load of said conventional doorbell system has been energized.

10. The automatic doorbell driver of claim 1, wherein said switching means comprises a transistor.

11. The automatic doorbell driver of claim 1, further comprising an ambient light sensor for sensing ambient light.

12. The automatic doorbell driver of claim 1, further comprising a radio frequency transmitter for communicating with a remote radio frequency receiver.

13. An automatic doorbell driver, comprising:

a. coupling means for coupling said automatic doorbell driver to a conventional doorbell system wherein said conventional doorbell system comprises a primary load;

b. power supply means for supplying power in a sufficient amount to operate said automatic doorbell driver;

c. a sensor selected from the group consisting of an audible sound sensor, a capacitive sensor, an infrared sensor, a microwave sensor, a radio frequency sensor, a visible light sensor, and an ultrasonic sensor; and d. switching means responsive to said sensor for coupling power to, and thereby controlling the energization and de-energization of, said primary load of said conventional doorbell system.

14. An automatic doorbell driver, comprising:

a. coupling means for coupling said automatic doorbell driver to a conventional doorbell system wherein said conventional doorbell system comprises a primary load;

b. power supply means for supplying power in a sufficient amount to operate said automatic doorbell driver;

c. sensing means for sensing an object in a proximity zone;

d. switching means responsive to said sensing means for coupling power to, and thereby controlling the energization and de-energization of, said primary load of said conventional doorbell system; and e. a circuit selected from the group consisting of a discrete logic circuit, an application specific integrated circuit, a microprocessor circuit, and a state machine circuit.

15. An automatic doorbell driver, comprising:

a. coupling means for coupling said automatic doorbell driver to a conventional doorbell system wherein said conventional doorbell system comprises a primary load;

b. power supply means for supplying power in a sufficient amount to operate said automatic doorbell driver;

c. sensing means for sensing an object in a proximity zone;

d. switching means responsive to said sensing means for coupling power to, and thereby controlling the energization and de-energization of, said primary load of said conventional doorbell system; and e. a means for continuously powering said primary load of said conventional doorbell system when said switching means is not coupling power to said primary load of said conventional doorbell system whereby said automatic doorbell driver is compatible with an electronic primary load.

16. A method for automatically driving a primary load of a conventional doorbell system, said method comprising:

a. extracting power from said conventional doorbell system in an amount sufficiently large so as to permit operation of a sensing means coupled to said conventional doorbell system but sufficiently small so as to prevent inadvertent energization of said primary load of said conventional doorbell system;

b. sensing an object in a proximity zone; and c. automatically coupling power to and thereby activating said primary load of said conventional doorbell system when said object is sensed within said proximity zone.

17. The method of claim 16, further comprising providing feedback informing said object in said proximity zone that said primary load of said conventional doorbell system has been energized.

18. A method for powering a doorbell system secondary load coupled to a conventional doorbell system wherein said conventional doorbell system comprises a primary load, said method comprising:

a. extracting power from said conventional doorbell system in an amount sufficiently large so as to permit operation of said secondary load but sufficiently small so as to prevent inadvertent energization of said primary load of said conventional doorbell system; and b. storing energy in a capacitor in a sufficient amount so as to permit continued operation of said secondary load and continued operation of said primary load of said conventional doorbell system when said primary load of said conventional doorbell system is energized.

19. A method for powering a doorbell system secondary load coupled to a conventional doorbell system wherein said conventional doorbell system comprises a primary load, said method comprising:

a. extracting power from said conventional doorbell system in an amount sufficiently large so as to permit operation of said secondary load but sufficiently small so as to prevent inadvertent energization of said primary load of said conventional doorbell system; and b. sharing power between said secondary load and said primary load of said conventional doorbell system in sufficient amounts so as to permit continued operation of said secondary load and continued operation of said primary load of said conventional doorbell system when said primary load of said conventional doorbell system is energized.

* * * * *